United States Patent [19]

Komuro et al.

[11] Patent Number: 4,881,318

[45] Date of Patent: Nov. 21, 1989

[54] METHOD OF MANUFACTURING A LIQUID JET RECORDING HEAD

[75] Inventors: Hirokazu Komuro, Hiratsuka; Masami Ikeda, Tokyo, all of Japan

[73] Assignee: Canon Kabushiki Kaisha, Tokyo, Japan

[21] Appl. No.: 228,677

[22] Filed: Aug. 5, 1988

Related U.S. Application Data

[60] Division of Ser. No. 77,090, Jul. 23, 1987, abandoned, which is a continuation of Ser. No. 740,494, Jun. 3, 1985, abandoned.

[30] Foreign Application Priority Data

Jun. 11, 1984 [JP] Japan ..... 59-118333

[51] Int. Cl.[4] ..... H01R 43/00

[52] U.S. Cl. ..... 29/827; 29/157 C; 29/855; 346/140 R; 264/272.16

[58] Field of Search ..... 29/827, 825, 855, 157 C; 346/140 R; 219/216; 264/272.16, 272.11

[56] References Cited

U.S. PATENT DOCUMENTS 4,499,480 2/1985 Takatori et al. ..... 346/140 R

FOREIGN PATENT DOCUMENTS 3237833 4/1983 Fed. Rep. of Germany .
59-38075 6/1984 Japan .
2106039 4/1983 United Kingdom .

*Primary Examiner*—Carl E. Hall
*Attorney, Agent, or Firm*—Fitzpatrick, Cella, Harper & Scinto

[57] ABSTRACT

A liquid jet recording head comprises a recording head unit for discharging liquid from an orifice by applying an energy to the liquid from an energy generator mounted on a substrate in order to form flying droplets, and a substrate member having an external wiring unit for supplying an electrical signal to said energy generator; wherein the electrical connection area for electrically connecting said energy generator and said external wiring unit is integrally molded by an insulative sealing material.

8 Claims, 3 Drawing Sheets

METHOD OF MANUFACTURING A LIQUID JET RECORDING HEAD

This is a division of application Ser. No. 077,090, filed July 23, 1987, which is a continuation of application Ser. No. 740,494, filed June 3, 1985, now abandoned.

BACKGROUND OF THE INVENTION

1. Field of the Invention

The present invention relates to a liquid jet recording head for jetting liquid to form flying droplets for recording on a medium.

2. Description of the Prior Art

A liquid jet recorder records by discharging liquid such as ink from a nozzle of a recording head. This type of recorder is attractive because noise generated during recording is negligibly low, the recorder attains high speed recording and the recording can be made on a plain paper without special treatment.

Among others, the liquid jet recording methods disclosed in Japanese Patent Application Laid-Open No. 51875/1979 and West Germany DOLS 2843064 are unique compared with other liquid jet recording methods because thermal energy is applied to the liquid to produce a motive force for discharging droplets.

In the disclosed recording method, thermal energy causes a rapid increase of volume in the liquid. Liquid is thus discharged from an orifice at an end of a recording head by the force due to this change is state, forming flying droplets. The droplets are then deposited on a record medium to form a recording.

The liquid jet recording method disclosed in the West Germany DOLS 2843064, may be applied to a drop-on demand type recording method or a fall line type method having a high density multi-orifice recording head. Hence, it enables rapid formation of a high resolution and high quality image.

The recording head used in the above recording method comprises a liquid discharge unit including an orifice for discharging liquid, a liquid flow path having a heating unit by which a thermal energy for discharging droplets is applied to the liquid, and an electro-thermal converter for generating the thermal energy.

In a prior art recorder having a liquid jet recording head, wiring for the recording head extends across a substrate to a flexible wiring cable connecting the recording head to a drive circuit which produces an electrical signal to drive the electrothermal converter of the recording head. The connecting pads of the flexible cable, for applying the electrical signal to the recording head, conventionally has been connected to wiring pads of the recording head by a press-contact method, a wire bonding method, soldering or by a thermal press-contact method. The flexible cable is then fixed to the recording head.

The substrate of the liquid jet recording head has one of a number of different wiring and heat generating resistor patterns depending on the desired end product e.g. eight lines with 2.5 lines/mm for a desk top calculator printer or sixteen lines with 4 lines/mm for a facsimile machine.

FIG. 1 shows a structure of a prior art liquid jet recording head. Numeral 1 denotes substrate, numeral 2 denotes electrodes through which electrical signals are supplied, numeral 3 denotes heat generating resistors which are electro-thermal converters, numeral 4 denotes an area of a protection film which protects the electrodes and the heat generating resistors from liquid, and numeral 5 denotes a flexible cable for connecting the substrate to a drive circuit.

In the prior art liquid jet recording head, the wiring area 6 is large and hence the quantity of the substrate material required for each head is large. Since the substrate material is made of an expensive material such as Si, the increase of the cost of the recording head due to this area of substrate is not negligible.

The excessive size of the substrate due to this unnecessary area reduces the efficiency of the etching, sputtering or vapor deposition process and impedes mass-production.

Further, because the mask used in production changes from product to product, the etching, sputtering or vapor deposition process becomes complex and the yield is lowered due to misoperation.

Still further, short-circuiting and bridging of the wiring occur with the same probability through the substrate area. Thus, the unnecessary area causes a reduction of the yield.

In a proposed liquid jet recording head, a substrate area having the head generating resistors formed therein is separated from the substrate on which the recording head is formed and the major electrodes of the separate substrate and the electrodes of the recording head are electrically connected. The electrical connection of the recording head (discharge element) and the major electrodes (external wiring unit) is illustrated in FIGS. 2 and 3.

Numeral 7 denotes the discharge element. A liquid chamber 8 is fixed to a side of the discharge element 7 and a plurality of orifices 9 for the liquid are formed in the liquid chamber 8. Heat generating elements 11 are formed on a side of the discharge element facing a substrate 10 opposite the orifices 9. Numeral 12 denotes lead electrodes for supplying a current to each heat generating element 11.

The discharge element 7 is mounted on a substrate 14 of an external wiring unit 13 and the electrodes 15 on the substrate 14 and the lead electrodes 12 are wire-bonded by wires 16. The bonding is sealed by sealing agent 17 to enhance reliability.

This structure, however, raises the following problem.

In order to improve the print quality in the liquid jet recording head, it is necessary to reduce the spacing between the orifices 9 and the recording paper. However, since the sealing agent 17 projects from the orifice plane, the space between the orifice plane and the recording paper cannot be reduced.

Further, as the spacing between the orifice plane and the recording paper is reduced, lowering the print quality. Alternatively, the sealing agent 17 is worn by the recording paper and the reliability of the sealing agent 17 and the reliability of the connecting area are lowered.

SUMMARY OF THE INVENTION

It is an object of the present invention to provide the liquid jet recording head which improves a reliability of electrical connection between an orifice element and an external wiring unit and reduces the cost thereof.

It is another object of the present invention to provide a liquid jet recording head having a recording head unit for discharging liquid from orifices by applying energy to the liquid by an energy generator arranged on a first substrate in order to form flying droplets, and a second substrate member having an external wiring unit for supplying an electrical signal to said energy generator, wherein an electrical connection area of the energy generator and the external wiring unit is sealed by an insulative sealing material.

DETAILED DESCRIPTION OF THE PREFERRED EMBODIMENTS

Figure 1:
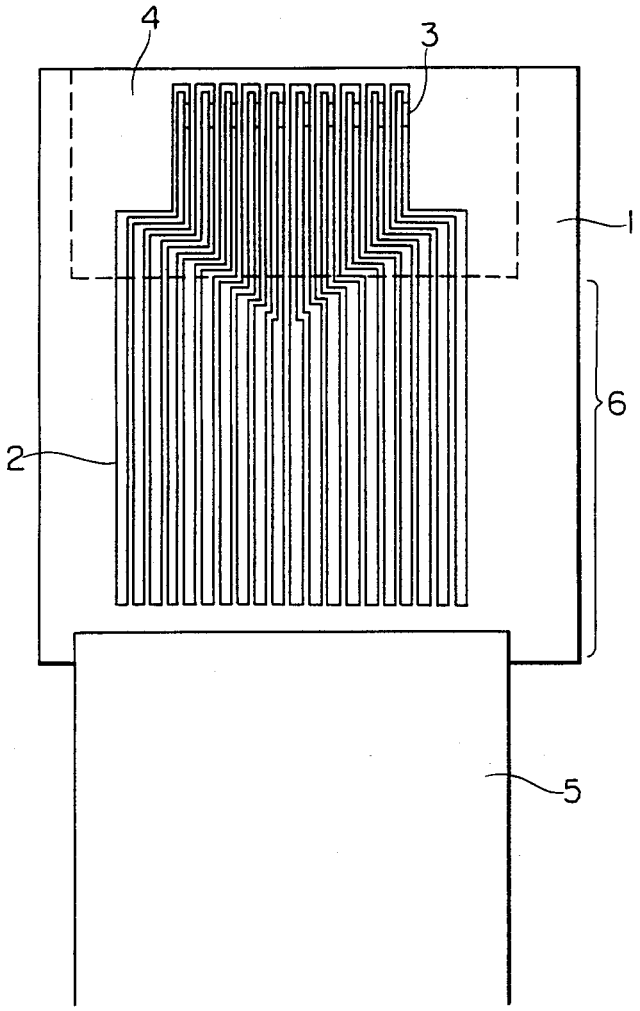
FIG. 1 is a plan view of a prior art structure.
Figure 2:
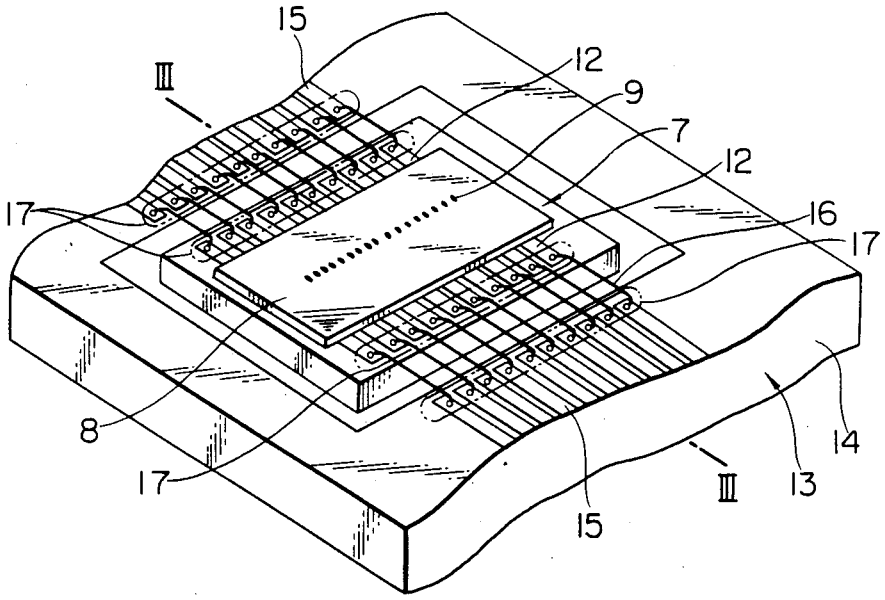
FIG. 2 is a perspective view of another prior art structure.
Figure 3:
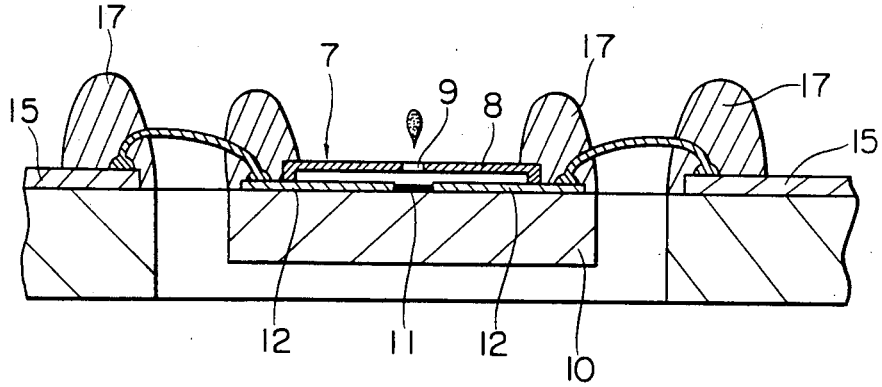
FIG. 3 is a sectional view taken along a line III—III of FIG. 2.
Figure 4:
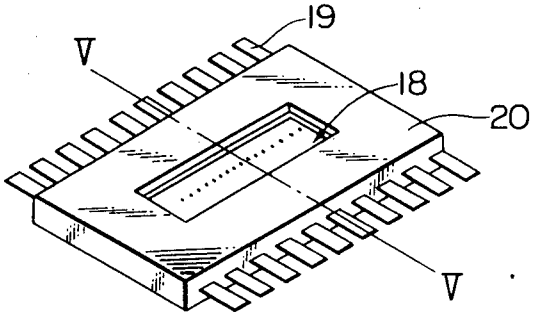
FIG. 4 is a perspective view of one embodiment of the present invention.
Figure 5:
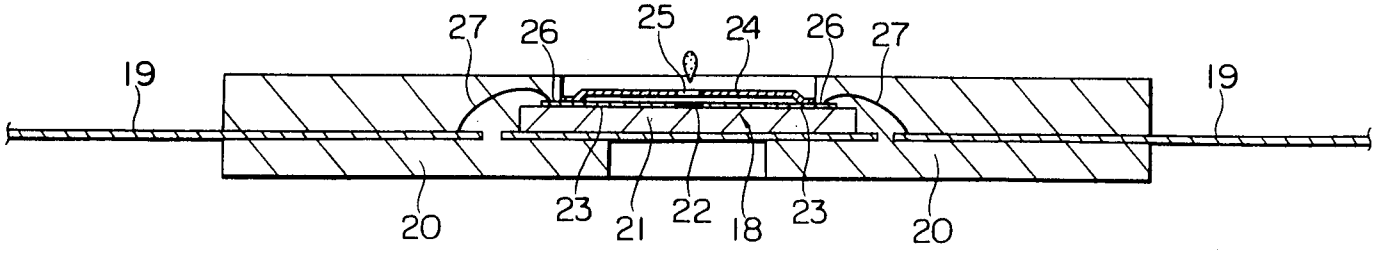
FIG. 5 is a sectional view taken along a line V—V in FIG. 4.

FIGS. 4 and 5 show one embodiment of the present invention. Numeral 18 denotes a discharge element, numeral 19 denotes a metal frame and numeral 20 denotes resin molded by a low pressure transfer mold method.

The discharge element 18 which is a recording head unit has a heat generating resistance layer 22 formed on a support 21 made of glass, ceramics or silicon, and lead electrodes 23 formed thereon. A protection layer (not shown) may be formed thereon as required. Numeral 24 denotes a liquid chamber forming member and numeral 25 denotes orifices.

The heat generating resistance layer 22 may be made of any material which generates heat when it is energized. For example, the material may be tantalum nitride, nichrome, silver-paradium alloy, silicon semiconductor, or a boron compound of metal such as hafnium, lanthanum, zirconium, titanum, tantalum, tangusten, molybdeum, niobium, chromium or banadium.

A metal- boron composition is particularly preferable as the material of the heat generating resistance layer 22. The most preferable composition is hafnium boronide, the next preferable ones being zirconium boronide, lanthanum boronide, tantalum boronide, banadium boronide and niobium boronide.

A heat generating resistance layer 22 made of one of those materials is formed by a electron beam vapor deposition method or a sputtering method.

The electrode 23 may be made of a conductive material capable of forming a pinholeless inorganic insulative layer thereon, such as A1, Ta, Mg, Hf, Zr, V, W, Mo, Nb, Si, or a composition thereof. Electrodes 23 made of one of these materials are formed by a vapor deposition method at predetremined areas with a predetermined size, shape and thickness.

The protective layer (not shown) may be made of an inorganic oxide such as $SiO_2$, an inorganic nitride such as $Si_3Na$, a transition metal oxide such as titanium oxide, vanadium oxide, niobium oxide, molybdenum oxide, tantalum oxide, tangsten oxide, chromium oxide, zirconium oxide, hafnium oxide, lanathanum oxide, ittrium oxide or manganese oxide, a metal oxide such as alunminum oxide, calcium oxide, strontium oxide, barium oxide, silicon oxide or composition thereof, a high resistance nitride such as silicon nitride, aluminum nitride, boron nitride or tantalum nitride, composition of the oxide and the nitride, or a semiconductor bulk such as an amorphous silicon or amorphous selenium, which generally has a low resistance but may have the high resistance in a course of sputtering, CVD, vapor deposition, vapor phase reaction or liquid coating method.

If required, a second protection layer made of oxide, carbonide, nitrode or a boronide of a metal such as A1, Ta, Ti, Zr, Hf, V, Nb, Mg, Si, Mo, W, Y, La or an alloy thereof may be formed. Pads made of gold are plated, screen-printed or vapor-deposited, as required, on an area 26 which is not covered by the liquid chamber. Finally, the liquid chamber forming member 24 for forming the liquid chamber is bonded by an epoxy or a silicone adhesive material. The liquid chamber forming member is formed by an electro-casting method by metal plating. The material thereof may be a noble metal such as nickel, copper, chromium, cobalt or a compound (e.g. phosphide) thereof. It may be molded by resin or the electro-casted liquid chamber forming member 24 may be bonded to a photo-resistive film. In this manner, the discharge element 18 is formed.

The discharge element 18 is then bonded to the metal frame 19 which is the substrate member having the external wiring unit formed thereon. The adhesive material is made of a high thermal conductivity silver paste, silver epoxy or epoxy. The lead frme which constitutes the external wiring unit and the lead electrodes 23 of the discharge element 18 is wire-bonded to electrically connect the energy generator and the lead frame which is the external wiring unit. The wires 27 are made of gold or aluminum. The metal frame 19 is made of a Fe-Ni alloy (e.g. 42 alloy) or a copper alloy and is formed by etching or punching. At least those areas of the lead which are to be wire-bonded are plated with gold or silver, as required.

After the wire-bonding of the metal frame, the metal frame is placed in a die for low pressure transfer molding.

The low pressure transfer molding die is designed to mold the metal frame into the shape shown in FIG. 4. It is designed to minimize flash on the discharge element and completely seal the electrical connection area.

The low pressure transfer molding resin may be an epoxy resin or a silicone resin. In the present embodiment, epoxy resin is used in view of cost reduction, water resisting property and chemical resisting property. The discharge element is made of a high thermal conductivity resin because of the large quantity of heat generated. Such resin may be Nitto-denko MP3500, MP4000, MP4300, Sumitomo Bakelite EME 5500 or EME 6500. The selected resin is molded in the low pressure transfer molding method to produce the package shown in FIG. 4.

In this manner, the sealng of the wire bonding area is made flat and thin, Accordingly, the spacing between the orifice plane and the recording paper can be reduced (to approximately 0.5 mm) and the print quality is improved.

Low pressure transfer molding is applicable to mass production and hence the total cost can be reduced. The mold can be treated as one part and a yield is improved. Thus, the total cost is further reduced.

As described hereinabove, in accordance with the present invention, since the electrical connection area of the discharge element and the external wiring unit is resin-molded in a flat and thin shape, the spacing between the orifice plane and the recording paper is reduced and the print quality is improved. In addition, since the resin in the connection area does not rub the recording paper, the reliability of the connection area is improved.

In the present invention, a protection layer is formed on the electrodes and/or the heat generating resistance layer. If the electrodes and/or the heat generating resistance layer are made of materials which are not eroded by the liqud, a protection layer is not necessary. Further, even if a protection layer is formed, it need not be a dual layer structure as specifically shown in the embodiment.

What is claimed is:

1. A method for manufacturing a liquid jet recording head, comprising the steps of:

providing a recording head unit including a support having an energy generator thereon and a cover attached to said support to form therewith a liquid chamber, wherein said cover has an orifice therein opposed to said energy generator for discharging liquid in said liquid chamber from said orifice by operating said energy generator;

providing a substrate member comprising a frame having a wiring unit including at least one connector;

electrically connecting electrodes for supplying an electrical signal to said energy generator to generate energy used to discharge flying droplets and said wiring unit for supplying the electrical signal to said electrodes; and molding said electrodes, said external wiring unit, said recording head unit and said substrate member into an integral unit with an insulative sealing material, wherein said connector extends externally of said integral unit.

2. A method for manufacturing a liquid jet recording head according to claim 1 wherein the sealing is effected by a low pressure transfer mold method.

3. A method for manufacturing a liquid jet recording head according to claim 1, wherein said insulative sealing material is resin.

4. A method for manufacturing a liquid jet recording head according to claim 3 wherein said resin is epoxy resin or silicone resin.

5. A method for manufacturing a liquid jet recording head according to claim 1 wherein said electrical connection is done by a wire-bonding method.

6. A method for manufacturing a liquid jet recording head according to claim 5 wherein a gold or aluminum wire is used in said wire-bonding method.

7. A method for manufacturing a liquid jet recording head according to claim 1 wherein said substrate member is a lead frame.

8. A method for manufacturing a liquid jet recording head according to claim 7, wherein said lead frame is made of metal.

* * * * *

UNITED STATES PATENT AND TRADEMARK OFFICE

CERTIFICATE OF CORRECTION

PATENT NO. : 4,881,318

DATED : November 21, 1989

INVENTOR(S) : HIROKAZU KOMURO, ET AL.

It is certified that error appears in the above-identified patent and that said Letters Patent is hereby corrected as shown below:

COLUMN 1

Line 52, "has" should read --have--.

COLUMN 2

Line 19, "through" should read --throughout--.
Line 23, "head generating resistors" should read --heat generating resistors--.
Line 50, "space" should read --spacing--.
Line 53, "reduced, lowering" should read --reduced, the sealing agent 17 rubs against the recorded paper, lowering--.
Line 60, "the" (second occurrence) should read --a--.
Line 61, "a" should read --the--.

COLUMN 3

Line 35, "silver-paradium alloy," should read --silver-palladium alloy,--.
Line 37, "titanum," should read --titanium,-- and "tangusten," should read --tungsten,--.
Line 38, "molybdeum," should read --molybdenum,-- and "banadium." should read --vanadium.--.
Line 44, "banadium boronide" should read --vanadium boronide--.
Line 46, "a" should read --an--.
Line 53, "predetremined" should read --predetermined--.

UNITED STATES PATENT AND TRADEMARK OFFICE

CERTIFICATE OF CORRECTION

PATENT NO. : 4,881,318

DATED : November 21, 1989

INVENTOR(S) : HIROKAZU KOMURO, ET AL.

It is certified that error appears in the above-identified patent and that said Letters Patent is hereby corrected as shown below:

COLUMN 3

Line 59, "tangsten oxide," should read --tungsten oxide,--.
Line 60, "lanathanum oxide," should read --lanthanum oxide,-- and "ittrium" should read --yttrium--.
Line 61, "alun-" should read --alu- --.
Line 63, "composition" should read --a composition--.
Line 65, "composition" should read --a composition--.
Line 68, "the" should read --a--.

COLUMN 4

Line 1, "a" should read --the--.
Line 4, "nitrode" should read --nitride--.
Line 23, "frme" should read --frame--.
Line 51, "sealng" should read --sealing--.
Line 52, "thin," should read --thin.--.

UNITED STATES PATENT AND TRADEMARK OFFICE

CERTIFICATE OF CORRECTION

PATENT NO. : 4,881,318

DATED : November 21, 1989

INVENTOR(S) : HIROKAZU KOMURO, ET AL.

It is certified that error appears in the above-identified patent and that said Letters Patent is hereby corrected as shown below:

COLUMN 5

Line 5, "liqud" should read --liquid--.

Signed and Sealed this

Sixteenth Day of June, 1992

*Attest:*

DOUGLAS B. COMER

*Attesting Officer*

*Acting Commissioner of Patents and Trademarks*